United States Patent [19]

Marysse

[11] Patent Number: 4,585,432

[45] Date of Patent: Apr. 29, 1986

[54] CARTON BLANK FOLDING, GLUEING AND STAPLING APPARATUS

[75] Inventor: Yves Marysse, Angers, France

[73] Assignee: Societe de Developpement de Materiels D'Emballage - Sodeme, Avrille, France

[21] Appl. No.: 602,548

[22] Filed: Apr. 20, 1984

[30] Foreign Application Priority Data

Apr. 22, 1983 [FR] France ..... 83 06696

[51] Int. Cl.[4] ..... B31B 1/68; B31B 3/02

[52] U.S. Cl. ..... 493/59; 493/119; 493/357; 271/270; 271/271; 271/273; 198/615

[58] Field of Search ..... 493/127, 128, 115, 126, 493/132, 59, 52, 121, 122, 356, 394, 385, 119, 56, 147, 357; 198/615, 461, 462; 271/270, 271, 273, 275

[56] References Cited

U.S. PATENT DOCUMENTS

| | | | |
|---|---|---|---|
| 1,979,253 | 11/1934 | Coy | 493/115 |
| 2,113,052 | 4/1938 | Kemp | 271/271 |
| 3,398,657 | 8/1968 | Saucier et al. | 493/119 |
| 3,605,585 | 9/1971 | Borders | 493/132 |
| 3,647,044 | 3/1972 | Orstam | 198/436 |
| 3,870,139 | 3/1975 | Wagner | 198/423 |
| 3,905,282 | 9/1975 | Heavner et al. | 493/89 |
| 4,118,025 | 10/1978 | Konars et al. | 271/273 |
| 4,456,117 | 6/1984 | Szczepanski | 198/461 |

*Primary Examiner*—Francis S. Husar
*Assistant Examiner*—William E. Terrell
*Attorney, Agent, or Firm*—Roylance, Abrams, Berdo & Goodman

[57] ABSTRACT

The present invention provides an installation for the continuous production of presecured folded cardboard packing cases, this installation comprising essentially a glueing unit, a folding unit, a two-speed positioning station and a stapler, disposed in line.

According to the invention, the positioning station comprises two devices (17 and 34) for transferring the sheets, the first of which (17) is formed by mechanical chains (18) with retractable studs (*24a* to *24d*) and the second (34) consists of a "drive sandwich" formed preferably from two superimposed trains of mobile belts (37 and 52), the upper belt train (37) being moveable in height. These first and second transfer devices may be made respectively inactive and operational, in response to setting the glueing unit alone in operation and respectively operational and inactive in response to setting the stapler in operation.

The belts (37,52) may be driven at the speed of passage of the sheets through the glueing unit, so that the installation of the invention may operate in a glueing mode without a reduction of productivity.

11 Claims, 8 Drawing Figures

CARTON BLANK FOLDING, GLUEING AND STAPLING APPARATUS

The present invention relates to an installation for the continuous production of preassembled (i.e. presecured) folded packing cases (i.e. boxes or cartons), from cardboard sheets or another flexible material of the same kind, this installation comprising end to end a cutting and scoring station for forming carton blanks from the sheets, a glueing unit, a folding unit and a stapling unit formed by a stapler preceded by a positioning station which is equipped with a transfer device for causing the blank to advance without slipping before introduction under the stapler, the glueing unit and the stapler being operatable separately or simultaneously for preassembling the cases in cooperation with the folding unit.

It is known that, for the facility of storage and transport, cardboard cases are not produced directly in their final parallelepipedic shape, but are simply preassembled in a folded form, in general by means of an installation of the type specified above, and are very often delivered in this folded form to the users.

In this installation, each blank coming from the cutting and scoring station has, on one of its lateral edges, a lug which will then be fixed to the opposite side edge of the sheet, after this latter has been folded.

In the majority of cases, a simple glueing is sufficient to achieve this fixing, the glueing unit being then used alone. But, if the cases to be produced are intended to support considerable loads, stapling must necessarily be provided, by operating the stapling unit and optionally making the glueing unit inoperative.

In this stapling unit, the positioning station, which serves for laterally positioning the folded blanks and making the lateral edges of their folded parts coincident, before they pass through the stapler, also functions to cause the sheets to advance one by one without slipping for introducing them into this latter. To this end, the transfer device of the positioning station is formed of pusher members which, because of their particular structure, limit the linear transfer speed of the blanks to a maximum value of 200 m/minute.

Now, the cardboard blanks may pass through the glueing unit at very high linear speeds, higher than 360 m/min, without the quality of the glueing being affected thereby.

Consequently, when the installation is used in its glueing (glueing only) mode, its productivity is considerably reduced because of the presence of the stapling unit in the path of the cardboard sheets.

To avoid this disadvantage, the only possibility which exists at present is to remove the stapling unit from the installation when it is desired to operate in glueing mode.

However, this operation causes numerous disadvantages. At first, rails must be positioned for withdrawing the stapling unit laterally. Furthermore, after this lateral withdrawing of the stapling unit, the reception station for the preassembled cases, which is normally located after the stapling unit, must be placed again in line at the outlet of the folding unit, with hereagain the need to provide rails for movement thereof.

Moreover, when it is desired to cause the installation to operate in its stapling (or glueing and stapling) mode, the above described operations must be carried out in the reverse order with of course the same constraints. Furthermore, the repositioning of the stapling unit in the installation is necessarily accompanied by a number of adjustments, relatively time consuming and tedious, for recentering and resynchronizing the stapling unit with the other work stations of the installation.

In conclusion, to convert an installation for preassembling cardboard cases from one operating mode to another by the present means, is a complex and constraining operation, which results moreover in a fairly considerable waste of time which cancels out a part of the benefit provided by increasing the productivity of the installation.

The present invention proposes overcoming these drawbacks and, for this, it provides an installation of the type specified in the preamble, for producing preassembled cases in the folded form, from cardboard sheets or another flexible material, which installation is characterized in that the positioning station is equipped with a second transfer device adapted for driving the blanks at their passage speed through the glueing unit, the first and second transfer devices being able to be made respectively inactive and operational in response to bringing the glueing unit alone into operation and respectively operational and inactive in response to bringing the stapler into operation.

Thus, when it is desired to cause the installation of the invention to operate in its glueing mode with maximum productivity, it is sufficient to make the first transfer device normally associated with the stapler inactive and to make the second transfer device operational. This operation is very brief all the more so since it may be automated in synchronism with operation of the glueing unit and of the stapler.

With the invention, cardboard case makers have no longer to dread the long and tedious operation of withdrawing the stapling unit laterally nor the accompanying operations and adjustments.

Advantageously, the second transfer device comprises a lower flat conveyor supported by the chassis of the positioning station and an upper flat conveyor moveably mounted above the first one, as well as control means for raising the upper conveyor out of the path of the sheets in response to bringing the stapler into operation and for placing it in a low position, in response to bringing the glueing unit alone into operation, in which the driving surfaces of the conveyors define, in the path of the folded blanks, a passage of a height slightly less than the total thickness of these latter.

In a preferred embodiment, each conveyor is formed by a train of parallel moveable belts each stretched between a motor driven pulley and one or more guide pulleys, so as to have a horizontal driving side forming said driving surface.

Thus, when the upper conveyor is in the low position, there is formed what may be called a "drive sandwich", the folded sheets leaving the folding unit being taken up one by one, then driven between the horizontal sides of the two trains of belts which may be set in motion at a speed equal to the speed at which the blanks pass through the glueing unit.

Furthermore, the upper conveyor is mounted on a mobile frame and, in a simple and advantageous embodiment, the means for controlling this movement of the upper conveyor comprise at least one cylinder whose rod is connected to the frame by a hinged connection of the deformable parallelogram type.

Preferably, the hinged connection is connected to the rod of the cylinder by a connecting piece mounted slideably on this latter and the free end of the rod of the cylinder is threaded to receive screwingly a ring for adjusting the height of the passage defined by the two conveyors.

Thus, to make the second transfer device inactive, it is sufficient to retract the rod of the cylinder; in fact during this movement, the adjusting ring pushes the connecting piece and thus causes the upper conveyor to be raised by bending the hinged connection. On the other hand, to make it operational, it is sufficient to completely extend the rod of the cylinder, the upper conveyor collapsing automatically by gravity until the connecting piece comes into abutment against the adjusting ring which, by its adjustable position, determines the height of the passage formed between the two conveyors.

Finally, in a preferred embodiment, the first transfer device is formed by one or more parallel mechanical chains stretched between toothed wheels mounted on the chassis of the positioning station, so as to exhibit horizontal sides extending just below the plane of advance of the sheets, these chains comprising retractable studs disposed in rows perpendicular to the advancing direction of the sheets.

Thus, by retracting these studs below their support chains, the first transfer device may be made inactive in a simple way. On the other hand, to make it operational, it is sufficient to maintain the studs in the raised position, which may be achieved by means of rails extending just below the horizontal sides of the chains and being able to be moved in a direction parallel thereto.

One embodiment of the present invention will now be described, solely by way of non limiting example, with reference to the accompanying drawings in which.

Figure 1:
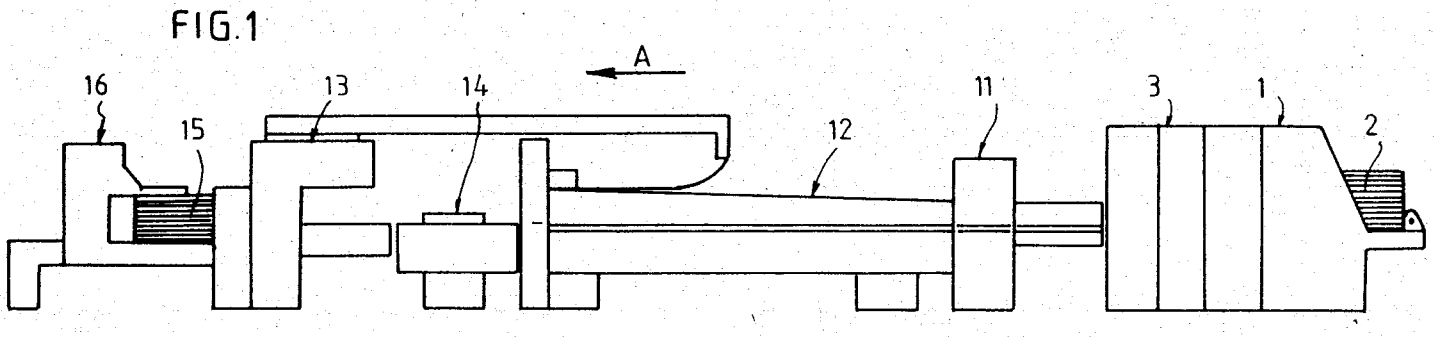
FIG. 1 is a lateral schematical view of an installation in accordance with the present invention.

As can be seen in FIG. 1, the installation of the invention, for preassembling cardboard packing cases in the folded condition, is in the form of a production line adapted for continuous operation.

At the beginning of the line, we find first of all a feeder 1 which holds in position a perfectly ordered stack 2 of cardboard sheets. At the outlet of this feeder 1, an automatic gripping device, not shown, is provided for gripping the cardboard sheet forming the bottom of stack 2 and placing it on the plate of a cutting and scoring station 3, or more generally, a means for forming carton blanks from the sheets. Station 3 is sometimes called a "slotter". A printer may be disposed if required between feeder 1 and the station 3 for printing on the cardboard sheets the details relative to the future contents of the cases.

Figure 2:
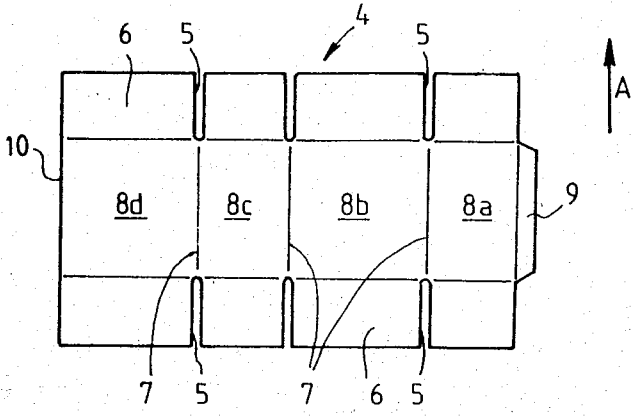
FIG. 2 is a top view of a cardboard sheet such as it appears at the outlet of the cutting out station of the installation of FIG. 1.

The cutting and scoring station 3 is equipped with tools known per se which give to each cardboard sheet the developed form of the case to be preassembled, as can be seen in FIG. 2. As is shown in this Figure, these tools form in sheet 4, on the one hand, slots 5 which define the flaps 6 of the case and, on the other hand, score or crease lines 7 which define its lateral faces 8*a* to 8*d*. Furthermore, a lug 9 is cut out from the free edge of an end face 8*a*, this lug 9 being intended, as will be seen further on, to be fixed, after sheet 4 has been folded, to the free edge 10 of the other end face 8*d*.

Downstream of station 3, is disposed a glueing unit 11 which is followed by a folding unit 12. A stapling unit, formed by a stapler 13 preceded by a positioning station 14, is further provided downstream of the folding unit 12. Each of these work stations 11, 12, 13 and 14 is equipped with transfer devices which ensure continuous travel of the cardboard blanks from the inlet to the outlet of the installation. It is known that, depending on the use to which they will be put, the cases may be preassembled, either by stapling, or by glueing lug 9 to the opposite free edge 10 of each blank. This is why the installation shown in FIG. 1 may be used either in its stapling mode by making the glueing unit 11 inoperative, or in its glueing mode by making the stapler 13 inoperative.

In the stapling mode, the cardboard blanks 4 coming from the station 3 are transferred directly, one after the other, to the folding unit 12, along the direction of advance shown by arrow A in FIG. 2.

Figure 3:
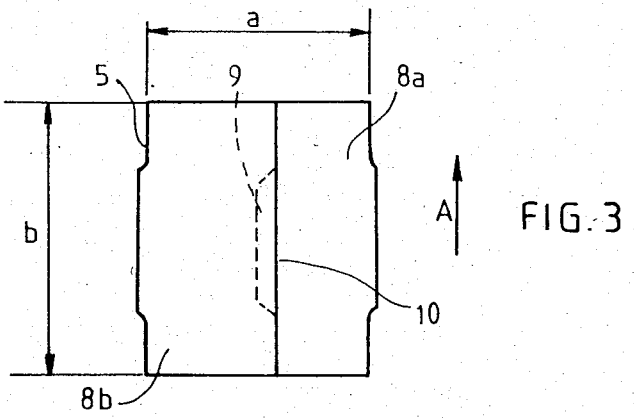
FIGS. 3 and 4 are respectively a top view and a front view of this cardboard sheet such at it appears at the outlet of the folding unit of the installation.
Figure 4:
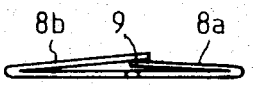

As can be seen in FIGS. 3 and 4, the folding unit folds the two end faces 8*a* and 8*d* down into the two central faces 8*b* and 8*c* of the sheet, so that edge 10 is applied on lug 9.

The blanks 4 thus folded then pass through the positioning station 14 where they are positioned laterally in an appropriate way before being introduced under the stapler 13 which then operates for stapling edge 10 to lug 9 of each sheet 4, at at least two points spaced apart from each other in the direction of advance A of the blanks. Each folded preassembled case thus obtained at the outlet of the stapling unit 13 is then discharged onto a stack 15 of previously preassembled cases, formed in a reception station 16.

If now the installation is caused to operate in its glueing mode, each sheet 4, coming from the cutting out station 3, is subjected, through the glueing unit 11 to the action of a coating roller not shown in the Figures which deposits a film of glue on lug 9 of blank 4. This latter is then folded, as shown in FIGS. 3 and 4 during its passage through the folding unit 12, the glue coated face of lug 9 being applied against edge 10 of the blank. The blank thus folded is then fed, through the stapler 13 which has been made inoperative, to the reception station 16 where, under the weight of stack 15, lug 9 is finally fixed to edge 10 by the film of glue after squaring by means of a device integrated in the reception station 16.

The positioning station 14 which forms more precisely the subject matter of the present invention will now be described with reference to FIGS. 5 and 6.

According to the primary feature of the invention the positioning station 14 is equipped with two separate transfer devices 17 and 34 which may be made operational separately for respectively causing the cardboard blanks 4 to advance without slipping, when the installation operates in its stapling mode and driving them at their passage speed through the glueing unit 11, when the installation is operating in the glueing mode.

Figure 5:
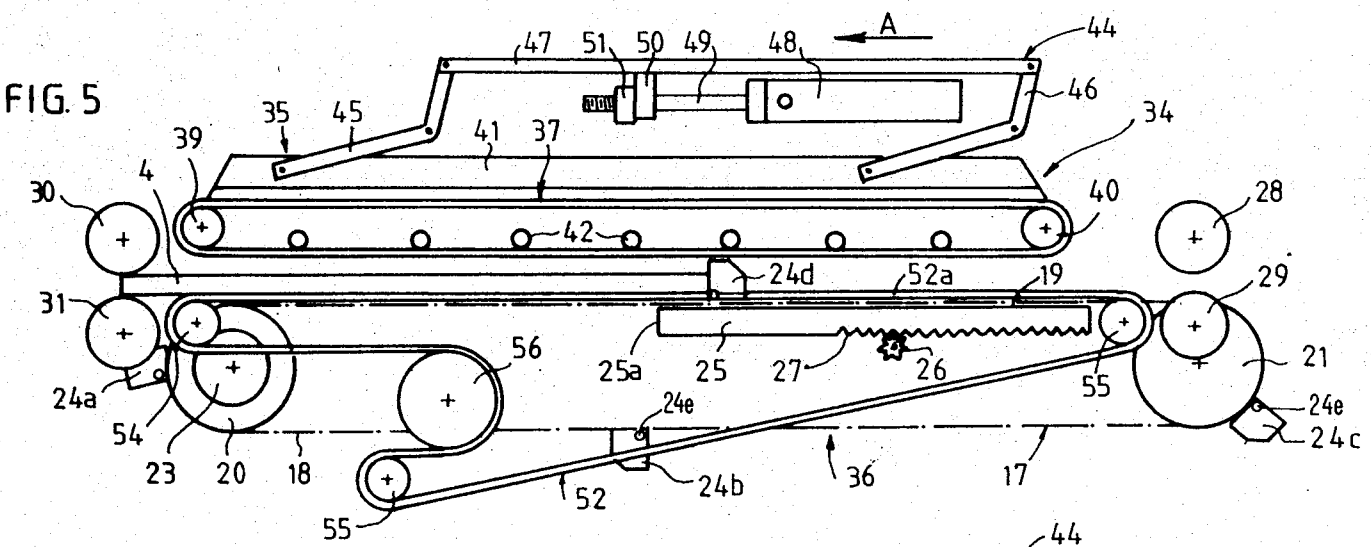
FIG. 5 is an enlarged side view of the positioning station of this installation, shown in its stapling position.
Figure 6:
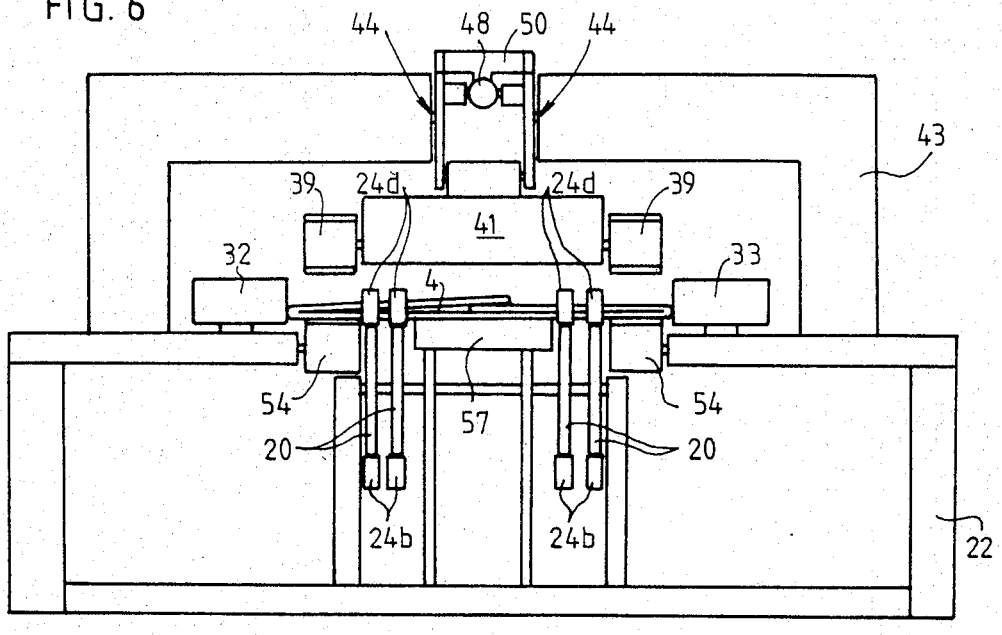
FIG. 6 is a cross sectional view of the positioning station such as shown in FIG. 5.

As can be seen in FIGS. 5 and 6 which show the positioning station 14 on a larger scale, the first transfer device 17 is formed of four parallel mechanical chains 18 which each have a horizontal side 19 extending just below the advancing plane of the blanks. Each of these chains 18 travels over two toothed wheels 20 and 21 mounted on the chassis 22 of the positioning station 14, respectively in the vicinity of the inlet and the outlet thereof, the downstream toothed wheels 20 of chains 18 being mounted on the shaft of a common drive motor 23 the speed of which is adjustable.

Referring more precisely to FIG. 5, it can be seen that four retractable studs 24*a*, 24*d* are hinged at equal intervals to each of chains 18 via hinges 24*c*, these studs being grouped in all in four rows perpendicular to the chains.

Moreover, a horizontal retraction rail 25 extends, from the inlet of the positioning station, just below the horizontal side 19 of each of chains 18 and along only a part thereof. Each rail 25 is mounted for sliding on chassis 22 and its position may be adjusted in the advancing direction A of the blanks, by means of a motor driven pinion 26 which cooperates with a rack 27 formed on the lower face of the rail.

Two pairs of motor driven rollers 28, 29 mounted one above the other about horizontal shafts, on each side of the train of chains 18, are further provided at the inlet of the positioning station, for defining a forced passage for sheets 4. Two pairs of identical rollers 30, 31 are disposed at the outlet of the positioning station.

Finally, two rows of rollers 32, 33 are mounted, in a way known per se, for free rotation about vertical shafts on the chassis 22 of the positioning station 14, so as to define, in the path of the blanks, a corridor which tapers slightly in the direction of the stapler 13, until it has a width equal to the half developed size a (see FIG. 3) of the sheet.

The second transfer device 34 is formed by two conveyors 35, 36 disposed one above the other.

The upper conveyor 35 is formed by two mobile parallel belts 37, 38 extending on each side of the group of chains 18 (see FIG. 5). The two belts 37, 38 travel respectively about a motor driven pulley 39 and a guide pulley 40 both supported by a mobile frame 41 moveable in a vertical plane, and each have a horizontal driving side 37*a*, 38*a* tensioned by a row of rollers 42 mounted freely rotatable on frame 41 (see FIG. 5).

The mobile frame 41 is mounted on a fixed mount 43 by means of two hinged connections 44 of the deformable parallelogram type. Each connection 44 is formed from two cranked arms 45, 46 whose ends are hinged respectively, on the one hand, to frame 41 at two points situated close to the ends thereof and, on the other hand, to a common cross piece 47. Furthermore, the two arms 45, 46 are hinged, at the bend thereof, to the fixed mount 43.

Connections 44 are associated with a cylinder 48, fixed for pivoting to mount 43, whose rod 49 which extends parallel to cross pieces 47 is connected thereto by a connecting piece 50. Connecting piece 50 is mounted freely slideable on the rod of cylinder 49, whose end is threaded to receive an adjusting ring 51 by screwing.

The lower conveyor 36 is formed by two parallel mobile belts 52, 53 each travelling around a motor driven pulley 54, several guide pulleys 55 and a tensioning pulley 56, all of them carried by chassis 22 and positioned so that belts 52, 53 have two horizontal sides 52*a*, 53*a*, situated respectively directly below the two horizontal sides 37*a*, 38*a* of belts 37, 38 and in vertical alignment therewith.

The operation of the positioning station 14 will now be described when the installation is used in its stapling mode, with reference to FIGS. 5 and 6.

Rod 49 of the cylinder 48 is previously retracted either by manual control, or by an automatic control synchronized with the starting up of the stapling unit; the adjusting ring 51 thus moves the connecting piece 50 in the direction causing the hinged connections 44 to fold up, which results in raising the train of upper belts 37, 38 to the position shown in FIGS. 5 and 6.

Motor 23 driving the toothed wheels 20 and the inlet rollers 28, 29 are then set in rotation at the same speed.

Then, the blanks 4 coming from the folding unit 12 are introduced one after the other into the positioning station, between the inlet rollers 28, 29.

Figure 7:
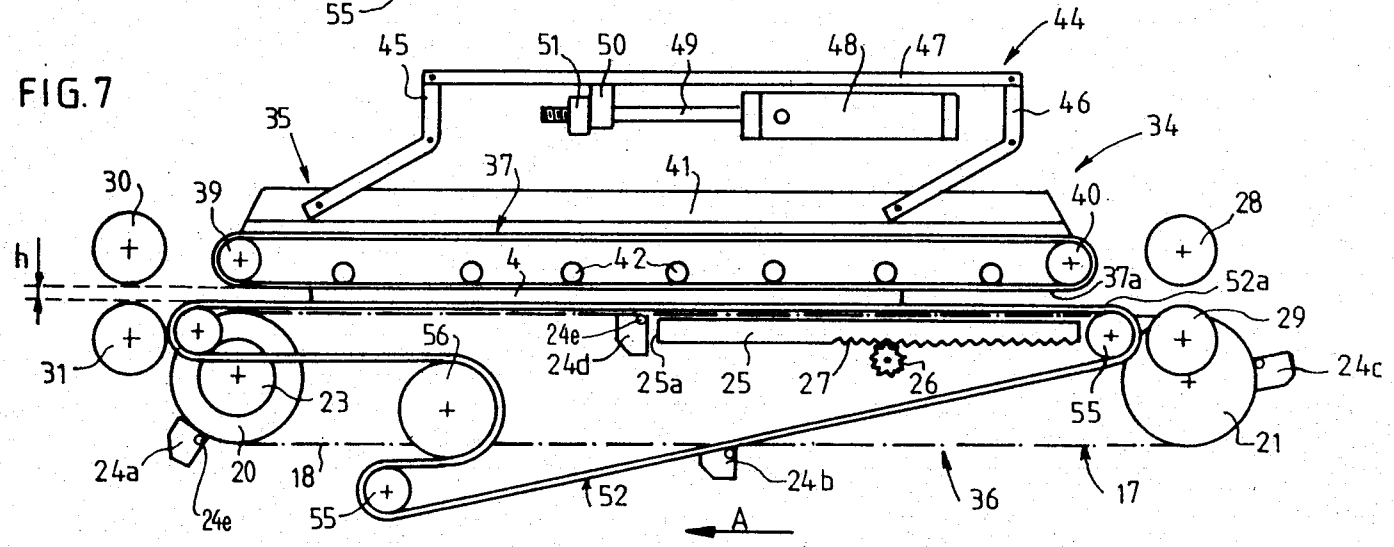
FIG. 7 is a side view of the positioning station shown in its glueing position.

Once completely introduced beyond these rollers, each blank 4 is pushed flat along the lower belts 52, 53 and a horizontal table 57 shown in FIG. 7, by a row of studs 24*a*, 24*b*, 24*c* or 24*d*, held raised up by bearing on rails 25. Of course, so that the transfer of the blanks may be effected correctly, the passage of the rows of studs between the two pairs of inlet rollers 28, 29 must be synchronized with the complete introduction of the blank beyond these latter, which may be provided by a very simple initial adjustment.

Once the front end of each folded blank 4 has been gripped by the outlet rollers 30 and 31, the studs swing downwardly under the effect of gravity beyond the front edge 25*a* of rails 25, the position of the rails being initially adjusted by means of pinion-rack assemblies 26, 27, so that the distance separating their front edge 25*a* from the shafts of rollers 30, 31 is equal to the machine direction size b of the blanks (see FIG. 4).

From then on, the blanks are caused to advance solely by the pairs of rollers 30, 31 which are linked to the transfer device of the stapler so as to be driven at the passage speed of the blanks through this latter.

During their transfer through the positioning station 14, blanks 4 are in addition correctly positioned, between the two rows of horizontal rollers 32 and 33 before their introduction into the stapler 13.

If it is now desired to cause the installation to operate in its glueing mode, motor 23 is caused to rotate at a slow speed, previous to bringing the glueing unit 11 into operation, until the three rows of studs 24*a*, 24*b*, 24*c* are below the horizontal side 19 of chains 18 and until the studs 24*d* of the fourth row swing beyond the edge 25*a* of the rungs, as shown in FIG. 7.

Figure 8:
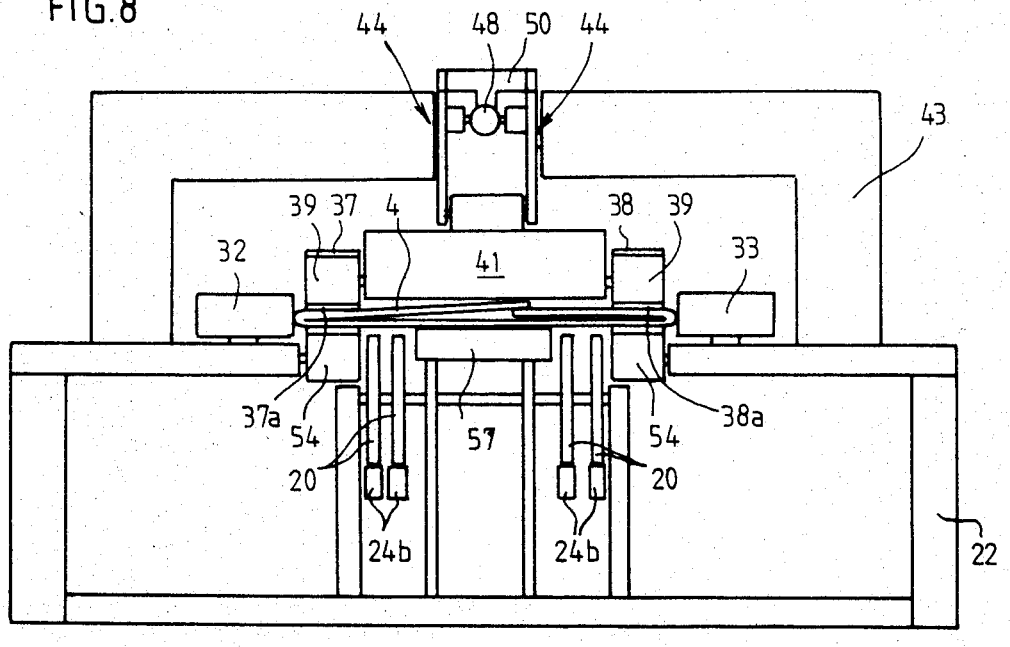
FIG. 8 is a cross sectional view of the positioning station such as shown in FIG. 7.

Then, the rod 49 of the cylinder 48 is completely extended, in synchronism with the start up of the glueing unit 11, so that the upper conveyor 35 collapses under its own weight until the connecting piece 50 comes into abutment against the adjusting ring 51. In this position, shown in FIGS. 7 and 8, the two conveyors 35, 36 define, in the path of blanks 4, a passage whose height h may be adjusted by means of the adjusting ring 51 so as to be very slightly less than the thickness of the folded blanks coming from the folding unit 12. Thus there is formed what might be called a drive sandwich in which the blanks may be transferred by being jammed between the two moving conveyors.

Then, the motor driven pulleys 39, 54 of belts 37, 38 and 52, 53 are set in rotation at the speed of passage of the sheets through the glueing unit 11. At the same time, the transfer devices of the folding unit 12 and of the stapler 13 formed also by drive sandwiches, as well as rollers 28, 29 and 30, 31 which are respectively coupled to the latter, are driven at the same speed.

Thus, blanks 4 are driven, over the whole length of the installation, at their speed of passage through the glueing unit 11, and the presence of the stapling unit 13 and 14 does not constitute an obstacle for using the installation in its glueing mode with maximum productivity.

It may happen that the stapler and the glueing unit have to be used at one and the same time for preassembling the cases. In this case, of course, only the first transfer device 17 will be made operational in the way described above.

In the glueing mode, the transfer device of the stapler and the rollers 28 to 31 are coupled through a known clutch mechanism, with the transfer devices of the folder and of the gluer and with the second transfer device of the positioning station, which has been rendered operative. Therefore, the transfer device of the stapler as well as the rollers 28 to 31 are driven at the glueing speed.

In the stapling or stapling and glueing mode, the transfer device of the stapler is disconnected from the other ones and coupled with its own driving motor to be driven at the stapling speed.

At the same time, the two pairs of rollers 28, 29 and 30, 31 are coupled with respective variable-speed motors to be driven at the same speed as the first transfer device of the positioning station which has just been rendered operative.

More precisely, the pair of outlet rollers 30 and 31 is driven at this speed as far as a folded cardboard sheet is pushed between them by a row of studs. But as soon as these studs are retracted under the chains, the pair of outlet rollers is driven at the stapling speed through an electromagnetic clutch acting on the variable speed motor in response to photocells which detect the retracting movement of studs.

Of course, as soon as the cardboard sheet is disengaged from the outlet rollers 30, 31, the latter are again driven at the speed of the first transfer device of the positioning station in response to photocells placed just at the outlet of these rollers on the path of the sheets.

It goes without saying that the invention is not limited to the embodiment described. More than two trains of parallel belts may for example be provided for the upper 35 and lower 36 conveyors; these latter may moreover be provided with other drive means, such as simple motor driven rollers mounted side by side. Similarly, the first transfer device 17 may comprise more than four chains with studs; a single chain, which would support studs covering the whole width of the positioning station, may even suffice.

Finally, the cylinder and the hinged connections may be replaced by any other means adapted for providing a movement in height of the upper conveyor 35.

I claim:

1. In an installation for the continuous production of folded, preassembled packing cartons from flexible sheets comprising, end to end along a flow path, means for forming carton blanks from the sheets, a glueing unit, a folding unit, a positioning station and a stapler; and means for moving the blanks from the blank forming means to the stapler along the flow path; the glueing unit and the stapler being means operable separately or simultaneously for preassembling the blanks in cooperation with the folding unit; the positioning station located therein being equipped with a first transfer device comprising means for driving the blanks without slippage at a specified speed before introduction of the blanks into the stapler, the improvement comprising:

a second transfer device, located in said positioning station, comprising means for driving the blanks before introduction of the blanks into the stapler at a speed that is higher than said specified speed and that is equal to the speed of passage of the blanks through the glueing unit;

means, coupled to said positioning station and said second transfer device, for selectively rendering said second transfer device operative or inoperative, and means, coupled to said positioning station and said first transfer device, for selectively rendering said first transfer device operative or inoperative.

2. An installation according to claim 1, wherein said means for selectively rendering said second transfer device operative or inoperative comprises means for moving a portion of said second transfer device towards and away from the path of the blanks through the positioning station.

3. An installation according to claim 1, wherein said means for selectively rendering said first transfer device operative or inoperative comprises means for introducing a portion of said first transfer device into the path of the blanks through the positioning station and for removing said portion of said first transfer device from the path of the blanks through the positioning station.

4. An installation according to claim 1, wherein said second transfer device comprises a lower flat conveyor rigidly supported in said positioning station, and an upper flat conveyor movably mounted in said positioning station above said lower flat conveyor.

5. An installation according to claim 4, wherein each of said conveyors is formed by a train of parallel mobile belts, each of said belts being tensioned between a motor driven pulley and at least one guide pulley oriented to provide a horizontal side to each of said belts.

6. An installation according to claim 5, wherein each of said horizontal sides on said belts forming said upper conveyor are supported on a row of idler rollers.

7. An installation according to claim 1, wherein said means for selectively rendering said second transfer device operative or inoperative comprises a conveyor, a frame coupled to said conveyor, a hinge coupled to the positioning station and to said frame, and means for pivoting said hinge and thus moving said conveyor.

8. An installation according to claim 7, wherein said means for pivoting comprises a cylinder and a rod slidably coupled to said cylinder, said hinge being connected to said rod via a connecting piece mounted for slideable movement on said rod, the free end of said rod carrying a stop element thereon.

9. An installation according to claim 8, wherein said rod and stop element are threadedly engaged and relatively movable.

10. An installation according to claim 1, wherein said first transfer device comprises at least one endless chain conveyor, each chain conveyor having a horizontal side extending first below the path of the sheets and carrying retractable studs disposed in rows perpendicular to the path of the blanks.

11. An installation according to claim 10, wherein said first transfer device further comprises at least one retraction rail extending just below the horizontal side of the chain conveyor, and means for moving said rail in the direction of said chain conveyor.

* * * * *